US006499825B2

(12) United States Patent
Suzuki

(10) Patent No.: US 6,499,825 B2
(45) Date of Patent: Dec. 31, 2002

(54) INK JET RECORDING APPARATUS

(75) Inventor: Kazunaga Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/788,599

(22) Filed: Feb. 21, 2001

(65) Prior Publication Data

US 2001/0005210 A1 Jun. 28, 2001

Related U.S. Application Data

(62) Division of application No. 09/459,377, filed on Dec. 13, 1999.

(30) Foreign Application Priority Data

Dec. 14, 1998 (JP) ..... 10-354626
Oct. 14, 1999 (JP) ..... 11-292839

(51) Int. Cl.[7] ..... B41J 2/165
(52) U.S. Cl. ..... 347/35
(58) Field of Search ..... 347/35, 92, 23, 347/60, 29, 22, 94

(56) References Cited

U.S. PATENT DOCUMENTS 4,466,005 A * 8/1984 Yoshimura ..... 347/92 X
4,525,728 A * 6/1985 Koto ..... 347/70
4,668,965 A 5/1987 Tanaka et al. ..... 347/35
4,887,100 A * 12/1989 Michaelis et al. ..... 347/69
4,965,608 A 10/1990 Shinohara et al.
5,805,182 A 9/1998 Lee

FOREIGN PATENT DOCUMENTS

| | | | |
|---|---|---|---|
| EP | 0 698 495 | 2/1996 | |
| JP | 4-128049 | 4/1992 | ..... 347/35 |
| JP | 9-183233 | 7/1997 | ..... B41J/2/175 |
| JP | 10230621 | 2/1998 | |

* cited by examiner

*Primary Examiner*—Huan Tran
(74) *Attorney, Agent, or Firm*—Wenderoth, Lind & Ponack, L.L.P.

(57) ABSTRACT

A recording head of an ink-jet-recording apparatus has a plurality of nozzles, a plurality of pressure chambers connected to the plurality of nozzles respectively, and an ink saving chamber connected to the plurality of the pressure chambers for supplying ink into the pressure chambers and for temporarily saving the ink. An ink way is connected to the ink saving chamber for supplying the ink into the ink saving chamber. A driver causes respective pressures in the pressure chambers to change in such a manner that the ink is jetted from the nozzles so as to carry out flushing operations of the nozzles. A flushing controller causes the driver to carry out the flushing operations so that a flushing operation for a first pressure chamber arranged relatively further from the ink way is delayed in starting for a predetermined time with respect to a flushing operation for a second pressure chamber arranged relatively closer to the ink way. In addition, the volume of ink jetted from the first pressure chamber during the flushing operation is greater than the volume of ink jetted from the second pressure chamber.

10 Claims, 11 Drawing Sheets

PRIOR ART

INK JET RECORDING APPARATUS

This application is a Divisional application of Ser. No. 09/459,377, filed Dec. 13, 1999.

FIELD OF THE INVENTION

This invention relates to an ink-jet recording apparatus having an ink-jet recording head capable of jetting ink from nozzles to form dots on a recording medium according to printing data. In particular, this invention is related to an ink-jet apparatus which can recover the ability of a nozzle to jet ink by discharging ink with no relation to a printing operation from the nozzles.

BACKGROUND OF THE INVENTION

FIG. 10 is a partly sectional view of a general recording head. The recording head has a base plate 46, piezoelectric vibrating members 42 vibratably contained and mounted in a containing space 53 formed in the base plate 46, and a passage unit 47 fixed to an under surface of the base plate 46.

The passage unit 47 has: a nozzle plate 50 having openings such as nozzles 40, a thin vibrating plate 43 which can deform elastically, and a passage forming plate 49 sealingly fixed between the nozzle plate 50 and the vibrating plate 43. In the passage forming plate 49, pressure chambers 41 respectively communicating with the nozzles 40, an ink saving chamber 48 for temporarily saving ink supplied into the pressure chambers 41, and ink supplying passages 51 respectively connecting the pressure chambers 41 and the ink saving chamber 48 are formed. On the other hand, the base plate 46 has an ink way 55 connecting to the ink saving chamber 48 through an ink supplying hole 52. Thus, new ink is supplied into the ink saving chamber 48 through the ink supplying hole 52.

The arrangement of the ink supplying hole 52, the ink saving chamber 48 and the pressure chambers 41 is explained with reference to FIG. 11. As shown in FIG. 11, the ink saving chamber 48 has a flat trapezoidal shape. The ink supplying hole 52 is connected to a substantially middle portion of the ink saving chamber 48. The pressure chambers 41 and the ink supplying passages 51 are arranged in parallel with each other in one side of the ink saving chamber 48. Each of the pressure chambers 41 and each of the ink supplying passages 51 are perpendicular to the longitudinal direction of the ink saving chamber 48. The pressure chambers 41 are respectively communicated to the nozzles 40.

Each of the piezoelectric vibrating members 42 is fixed to a supporting plate 54 fixed in the containing space 53 of the base plate 46 in such a manner that the piezoelectric member 42 can vibrate in the containing space 53. A lower end of the piezoelectric vibrating member 42 adheres to an island portion 43*a* of the vibrating plate 43 of a passage unit 47.

The recording head operates as below. At first, electric power is supplied to a piezoelectric vibrating member 42. Then, as shown in FIGS. 12*a* and 12*b*, the piezoelectric vibrating member 42 contracts with respect to a normal original state thereof, a pressure chamber 41 expands with respect to a normal original state thereof, and the pressure therein is reduced. Thus, a meniscus 46 of ink in a nozzle 40 is dented toward the pressure chamber 41, and ink in an ink saving chamber 48 is supplied into the pressure chamber 41 through an ink supplying passage 51.

When electric charges are discharged from the piezoelectric vibrating member 42 after a predetermined time, the piezoelectric vibrating member 42 returns to the original state thereof, as shown in FIG. 12*c*. Then, the pressure chamber 41 contracts and the pressure therein is increased. Thus, the ink in the pressure chamber 41 is pressed to jet from the nozzle 40 as ink drops, which form images or characters on the recording paper.

In the above recording head, the ink 44 in the nozzles 40 may dry up and clog the nozzles 40 while the recording head remains stopped after a printing operation. Then, the nozzles are sealed by a capping unit except while the recording head is in the printing operation. However, a solvent of the ink 44 in the nozzles 40 may gradually evaporate to increase a viscosity of the ink 44 if the nozzles are sealed for a long time. In that case, it may be difficult to start a printing operation immediately. In addition, there may be some troubles, including that the quality of printed images may deteriorate.

During the printing operation, the nozzles 40 frequently jetting inkdrops 45 are scarcely clogged with the ink 44 because new ink 44 is supplied thereinto in succession. However, even during the printing operation, the nozzles 40 rarely jetting inkdrops 45 (for example, the nozzles arranged at an upper end portion or a lower end portion) are liable to be clogged with the ink 44 because the ink 44 in such nozzles 40 is liable to dry to increase the viscosity thereof.

To solve the above problems, a "flushing operation" or a "cleaning operation" is carried out by forcibly discharging the clogging ink 44 from the nozzles 40 in no relation to the printing operation, to recover the ability of the nozzles 45 to jet inkdrops. The above flushing or cleaning operation may be carried out when power supply starts to be given to the recording apparatus or when a first printing signal is inputted to the recording apparatus, as a preparatory step before the printing operation.

In the flushing operation, a driving signal in no relation to the printing data is supplied to the piezoelectric vibrating members 42 to jet the clogging ink 44 having a relatively increased viscosity from the nozzles 40. The cleaning operation is carried out when the ability of the nozzles to jet inkdrops is not sufficiently recovered by the flushing operation. In the cleaning operation, a suction pump applies a negative pressure to the nozzles 40 to forcibly absorb the clogging ink 44 having a relatively increased viscosity from the nozzles 40.

The degree of the increasing viscosity of the ink 44 in the nozzles 40, i.e., the degree of clogging the nozzles 40, becomes worse depending on the length of the capping time for which the recording head remains sealed by the capping unit or on the length of the total printing time until, the recording head is sealed by the capping unit.

Therefore, as shown in FIG. 13, whether the flushing operation or the cleaning operation should be carried out is determined by the combination of the capping time and the total printing time. The flushing operation is carried out when the capping time or the total printing time is relatively short (see a flushing area in FIG. 13). The cleaning operation is carried out when the capping time or the total printing time is relatively long (see a cleaning area in FIG. 13).

In the above apparatus, when ink in the pressure chambers 41 is consumed for a flushing, cleaning or printing operation, new ink is supplied from the ink supplying hole 52 into the pressure chambers 41 through the ink saving chamber 48. Then, the new ink supplied from the ink supplying hole 52 flows easily into the pressure chambers 41 disposed near to the ink supplying hole 52. However, on the contrary, it is difficult for the new ink supplied from the ink supplying hole 52 to flow into the pressure chambers 41 disposed far from the ink supplying hole 52. Thus, there may be a difference in viscosity of the ink in the different portions of the ink saving chamber 48. That is, the viscosity of the ink at a portion near to the ink supplying hole 52 may be different from the viscosity of the ink at a portion far from the ink supplying hole 52.

For example, as shown in FIG. 11, the viscosity of the ink in the ink saving chamber 48 may be highest to lowest in the order of D area, C area, B area and A area. In that case, volumes of ink jetted from the nozzles 40 far from the ink supplying hole 52 in the flushing operations may be small when the same driving signal is used for all of the pressure chambers 41. Thus, ink having an increased viscosity might remain in the pressure chambers 41 far from the ink supplying hole 52. That is, the ability of the nozzles 40 far away from the ink supplying hole 52 to jet ink might not be recovered sufficiently. In that case, there may be such a difference in the ability to jet ink due to the positions of the nozzles 40 so that the quality of printing may deteriorate.

In addition, when a flushing operation is carried out for a pressure chamber 41 in which ink having an increased viscosity remains, as shown in FIG. 14, a meniscus 46 of the ink may become unstable and dented deeply and obliquely to take an air bubble in the nozzle 40. Thus, a cleaning m operation has to be carried out to remove the ink having the increased viscosity from the pressure chambers 41 far from the ink supplying hole 52, even when the ability to jet ink of the nozzles 40 near to the ink supplying hole 52 can be recovered by flushing operations. That is, a range of conditions wherein the ability of the nozzles 40 to jet ink can be recovered by only the flushing operations (which range is called a flushing area) is small.

In this case, a relatively larger volume of ink may be necessary to recover the ability of the nozzles 40 to jet ink. That is, the volume of ink capable of being used for the printing operation may be small, and the volume of the waste ink may be large.

SUMMARY OF THE INVENTION

The object of this invention is to solve the above problems, that is, to provide an ink-jet recording apparatus that can carry out efficient flushing operations by changing the conditions for the flushing operations depending on distances of the pressure chambers from the ink supplying hole.

In order to achieve the object, an ink-jet recording apparatus includes a recording head having: a plurality of nozzles, a plurality of pressure chambers connected to the plurality of nozzles respectively, an ink saving chamber connected to the plurality of the pressure chambers for supplying ink into the pressure chambers and for temporarily saving the ink, and an ink way connected to the ink saving chamber for supplying the ink into the ink saving chamber. The ink-jet recording apparatus also includes a driver for causing respective pressures in the pressure chambers to change in such a manner that the ink is jetted from the nozzles to carry out flushing operations of the nozzles, and a flushing controller for causing the driver to carry out the flushing operations so that a flushing operation for a pressure chamber arranged relatively further from the ink way is delayed starting for a predetermined time with respect to a flushing operation for another pressure chamber arranged relatively closer to the ink way.

According to the above feature, the flushing operation for the pressure chamber arranged relatively further from the ink way (ink supplying hole) is delayed starting for a predetermined time. Thus, new ink is easily and sufficiently supplied into the pressure chamber arranged relatively further from the ink way during the flushing operation. This reduces the difference in viscosity of the ink due to portions in the ink saving chamber. Therefore, in the flushing operations, sufficient volumes of ink may be respectively jetted from the nozzles communicated to the pressure chambers, even if the pressure chambers are arranged far from the ink way. That is, the ability of the nozzles to jet ink can be recovered sufficiently to prevent the quality of printing from deteriorating.

In addition, a meniscus of the ink may remain stable to prevent an air bubble from being taken into the nozzles since the new ink is always supplied by the flushing operations. Furthermore, the flushing area wherein the ability of the nozzles to jet ink can be recovered by only the flushing operations may be enlarged. In addition, the volume of ink necessary to recover the ability of the nozzles to jet ink may be reduced, the volume of ink capable of being used for the printing operation may be increased, and the total volume of the waste ink may be reduced.

Preferably, the flushing controller may cause the driver to carry out the flushing operations so that flushing operations for at least three pressure chambers have delayed starts for respective predetermined times. The predetermined times may depend on respective distances of the pressure chambers from the ink way.

Furthermore, the flushing controller may cause the driver to carry out the flushing operations so that the flushing operations for all the pressure chambers have delayed starts for respective predetermined times. The predetermined times may also depend on respective distances of the pressure chambers from the ink way.

In addition, the flushing controller may cause the driver to carry out the flushing operations so that the flushing operations for each two of the pressure chambers are not carried out simultaneously. Alternatively, the flushing operation controller may cause the driver to carry out the flushing operations so that the flushing operations for each two of the adjacent pressure chambers are carried out partly simultaneously.

The pressure chambers may be classified into at least two classes (or groups) according to respective distances of the pressure chambers from the ink way in such a manner that if the distance of a pressure chamber of a first class from the ink way is less than the distance of a pressure chamber of a second class from the ink way, a distance of any pressure chamber of the first class is less than a distance of any pressure chamber of the second class from the ink way. In this case, the flushing controller may cause the driver to carry out the flushing operations so that flushing operations for all pressure chambers of each class have delayed starts for the same predetermined time. The predetermined time for each class may depend on respective distances of the pressure chambers of each class from the ink way.

In that case, since the flushing operations for all pressure chambers of each class have delayed starts for the same predetermined time, the flushing operations may be easily controlled and completed in a shorter period.

The driver may have a plurality of piezoelectric members or a plurality of heating members mounted on the respective pressure chambers to change the pressures in the respective pressure chambers.

Another ink-jet recording apparatus includes a recording head having: a plurality of nozzles, a plurality of pressure chambers connected to the plurality of nozzles respectively, an ink saving chamber connected to the plurality of the pressure chambers for supplying ink into the pressure chambers and for temporarily saving the ink, and an ink way connected to the ink saving chamber for supplying the ink into the ink saving chamber. The ink-jet recording apparatus also includes a driver for causing respective pressures in the pressure chambers to change in such a manner that the ink is jetted from the nozzles to carry out flushing operations of the nozzles, and a flushing controller for causing the driver to carry out the flushing operations so that a volume of the ink jetted in a flushing operation for a pressure chamber arranged relatively further from the ink way is greater than a volume of the ink jetted in a flushing operation for another pressure chamber arranged relatively closer to the ink way.

According to the above feature, the volume of the ink jetted in the flushing operation for the pressure chamber arranged relatively further from the ink way (ink supplying hole) is greater. Thus, new ink is easily (smoothly) and sufficiently supplied into the pressure chamber arranged relatively further from the ink way in the flushing operation. This reduces the difference in viscosity of the ink in different portions of the ink saving chamber. Therefore, in the flushing operations, sufficient volumes of ink may be respectively jetted from the nozzles communicating with the pressure chambers, even if the pressure chambers are arranged far from the ink way. That is, the ability of the nozzles to jet ink can be recovered sufficiently to prevent the quality of printing from deteriorating.

In addition, the flushing area may be enlarged, the volume of ink necessary to recover the ability of the nozzles to jet ink may be reduced, the volume of ink capable of being used for the printing operation may be increased, and the total volume of the waste ink may be reduced.

Preferably, the flushing controller may cause the driver to carry out the flushing operations so that respective volumes of ink jetted in flushing operations for at least three pressure chambers are great in order of respective distances of the pressure chambers from the ink way.

Furthermore, the flushing controller may cause the driver to carry out this flushing operations so that respective volumes of ink jetted in flushing operations for all pressure chambers are great in order of respective distances of the pressure chambers from the ink way. In this case, the new ink may be easily supplied into the whole ink saving chamber.

The pressure chambers maybe classified into at least two classes according to respective distances of the pressure chambers from the ink way in such a manner that if a distance of a pressure chamber of a first class from the ink way is less than a distance of a pressure chamber of a second class from the ink way, a distance of any pressure chamber of the first class from the ink way is less than a distance of any pressure chamber of the second class. In this case, the flushing controller may cause the driver to carry out the flushing operations so that volumes of ink jetted in the flushing operations for all the pressure chambers of each class are the same levels. The level for each class may depend on respective distances of the pressure chambers of each class from the ink way.

In this case, since the volume of ink jetted in the flushing operations for all the pressure chambers of each class are the same levels, the flushing operations may be easily controlled and completed in a shorter period.

Furthermore, the flushing controller may cause the driver to carry out the flushing operations so that the flushing operations for all the pressure chambers start simultaneously and so that a operation for a pressure chamber arranged relatively further from the ink way has delayed stops for a predetermined time with respect to a flushing operation for another pressure chamber arranged relatively closer to the ink way.

In that case, since the flushing operations for all the pressure chambers start simultaneously, the flushing operations may be completed by a shorter period.

Preferably, the flushing controller may control a driving frequency of the driver. For example, the flushing operation controller may control the driving frequency of the driver in such a manner that the driving frequency is great when the volume of the ink jetted in the flushing operation is large, and that the driving frequency is low when the volume of the ink jetted in the flushing operation is little.

Alternatively, the flushing controller may control respective changing ranges of the pressures in the respective pressure chambers via the driver.

The driver may have a plurality of piezoelectric members or a plurality of heating members mounted on the respective pressure chambers to change the pressures in the respective pressure chambers.

In addition, the flushing controller may control the driving frequency of the driver in such a manner that the driving frequency is high at the beginning of the flushing operation. According to this feature, the ink in the nozzle may be loosened by the flushing operation of the high frequency. Thus, the flushing operation may be carried out more effectively.

Figure 11:
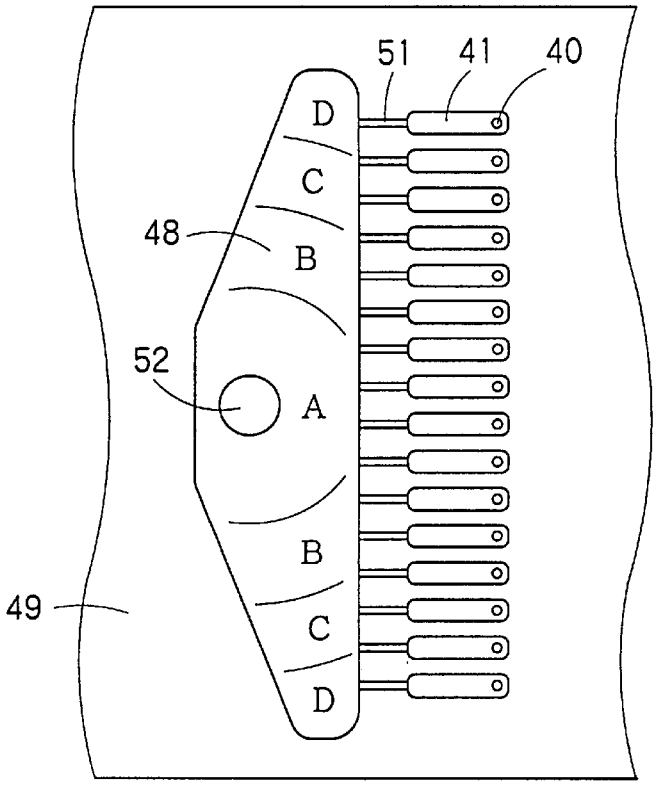
FIG. 11 PRIOR ART
Figure 12A:
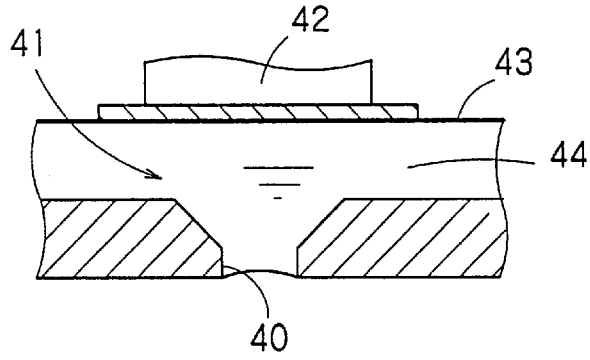
FIG. 12a PRIOR ART
Figure 12B:
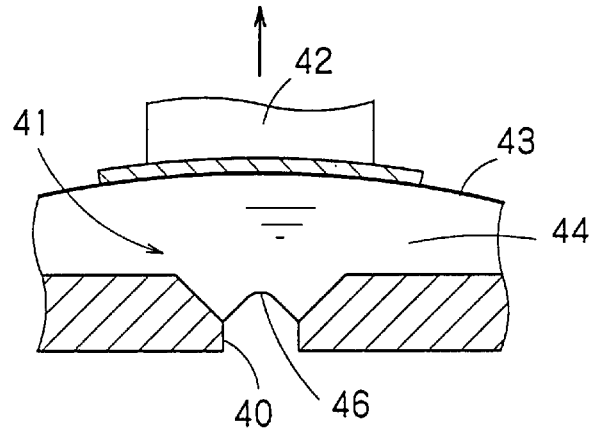
FIG. 12b PRIOR ART
Figure 12C:
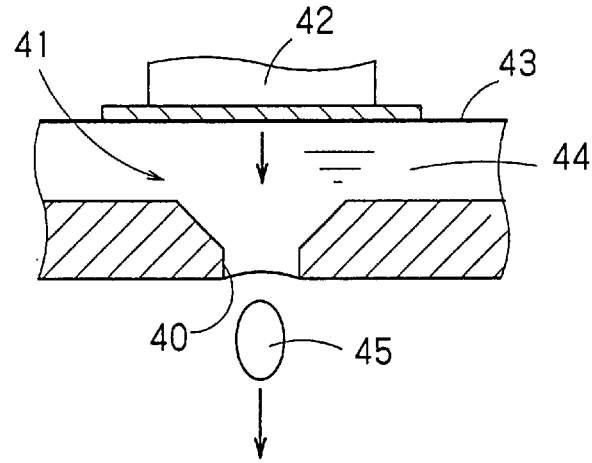
FIG. 12c PRIOR ART
Figure 13:
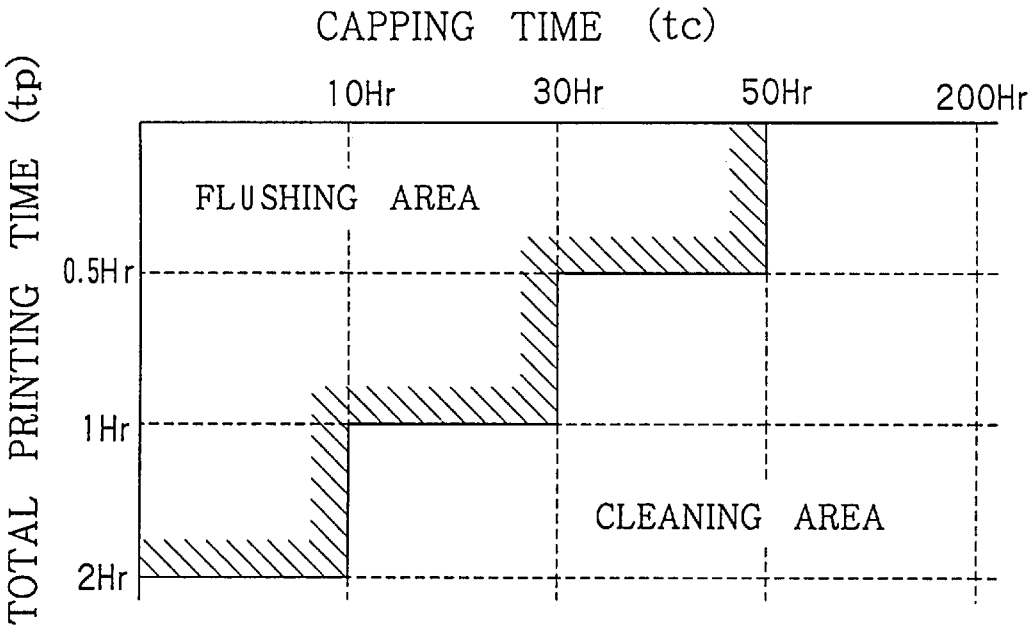
F I G. 13 PRIOR ART
Figure 14:
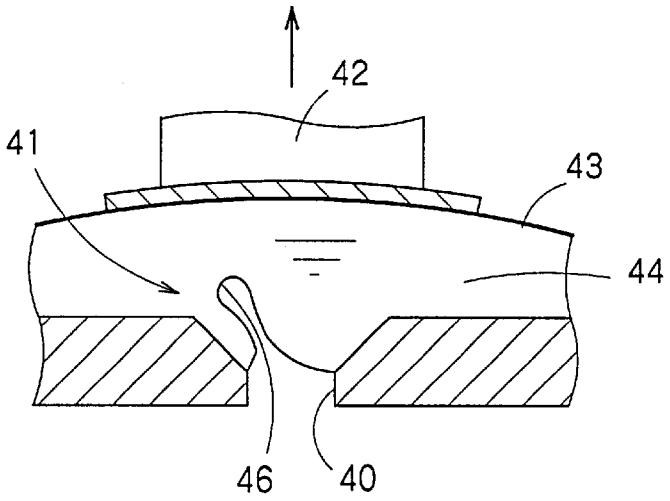
Figure 15:
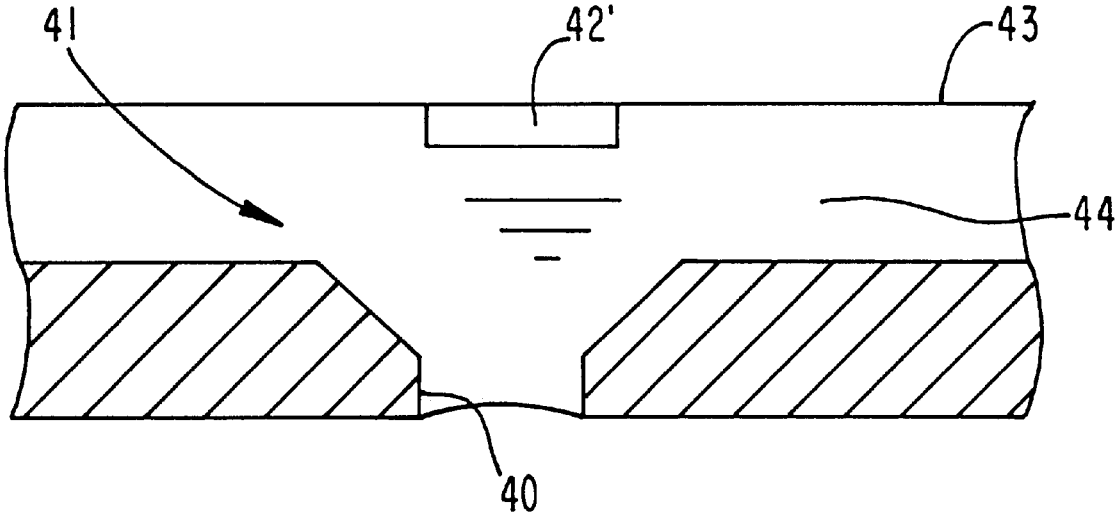
Figure 16:
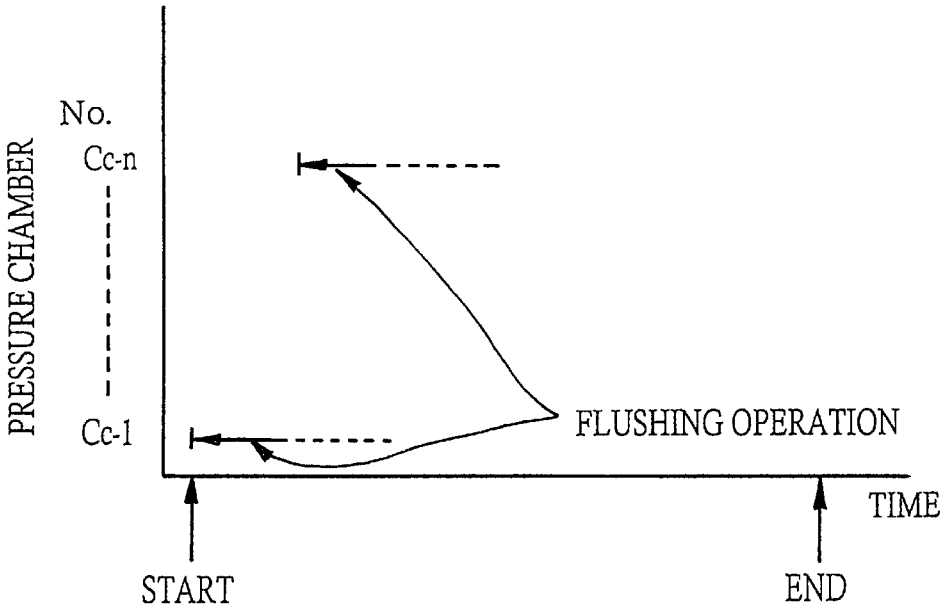
Figure 17:
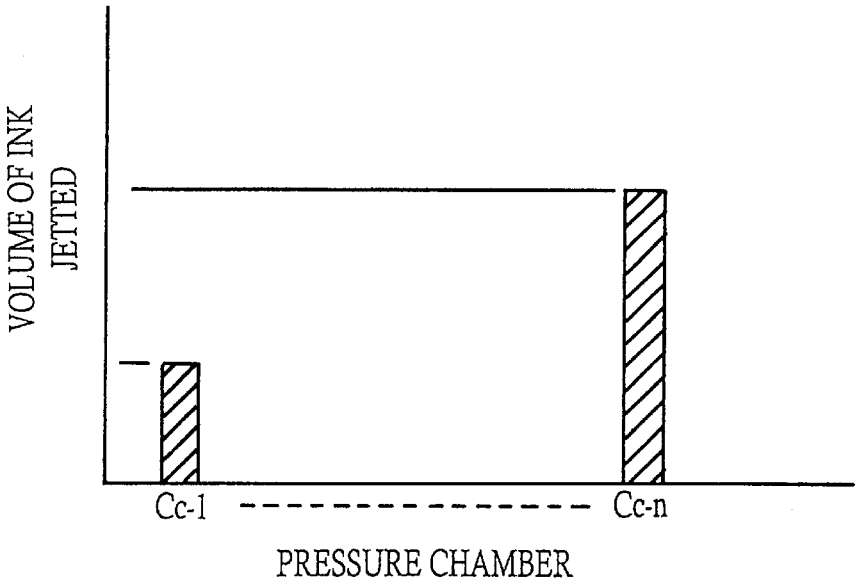

Fig .10 is a partly sectional view of a conventional ink-jet recording head;

FIG. 11 is a plan view of the passage forming plate and the nozzle plate of the conventional recording head;

FIGS. 12*a* to 12*c* are sectional views of the conventional recording head at a normal state, at a state in which the piezoelectric vibrating member contracts, at a state in which an inkdrop is jetted, respectively;

FIG. 13 is a graph representing mode conditions by the capping time and the printing time in FIG. 14 is a sectional view of the recording head of the conventional ink-jet recording apparatus for explaining the state of the meniscus in the flushing operation;

FIG. 15 is a sectional view of the recording head of the ink-jet recording apparatus according to the present invention showing the heating members;

FIG. 16 is an explanatory graph for showing the operation of the ink-jet recording apparatus of the fifth embodiment; and FIG. 17 is another explanatory graph for showing the operation of the ink-jet recording apparatus of the fifth embodiment.

BEST MODE FOR CARRYING OUT THE INVENTION

Embodiments of the invention will now be described in more detail with reference to drawings.

First Embodiment

Figure 1:
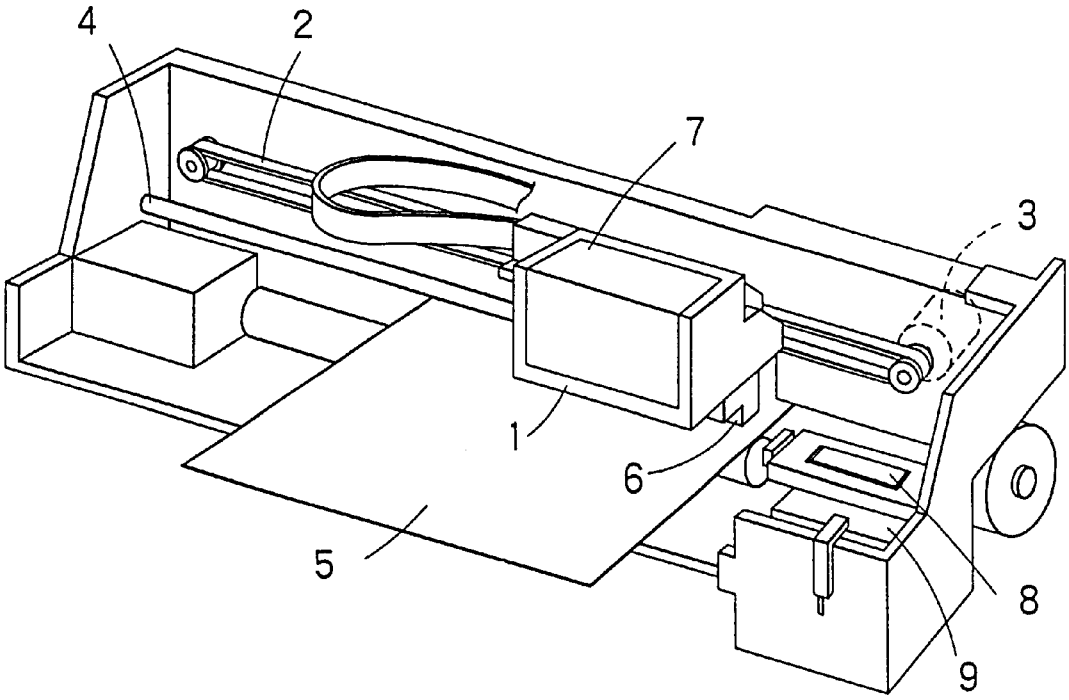
FIG. 1 is a perspective view of a first embodiment of the ink-jet recording apparatus according to the invention.
Figure 10:
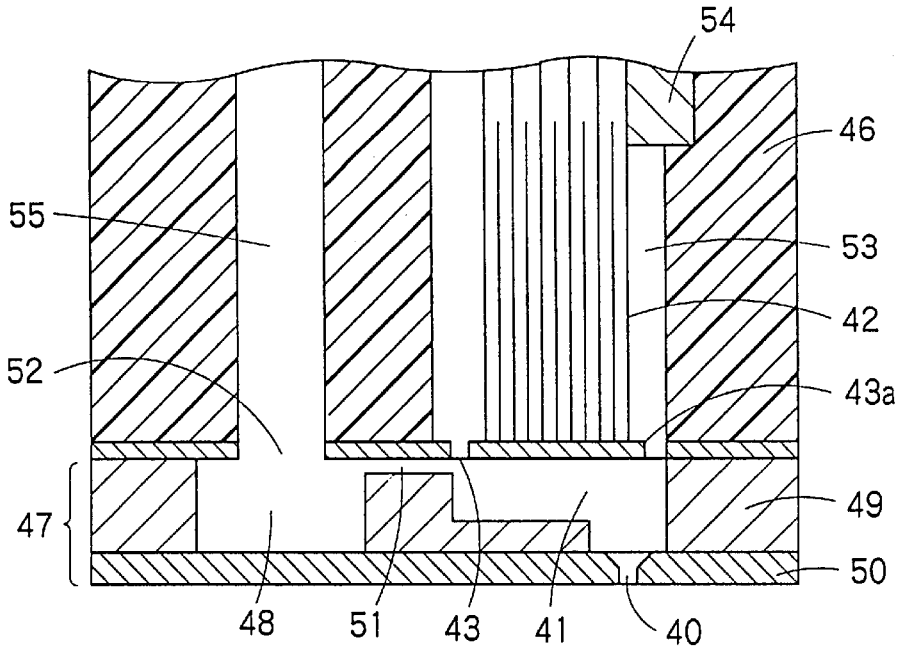
FIG. 10 PRIOR ART

FIG. 1 is a perspective view of a first embodiment of the ink-jet recording apparatus according to the invention. The apparatus has a carriage 1 on which an ink cartridge 7 is mounted and under which a recording head 6 is mounted. The apparatus also has a capping unit 8 capable of sealing the recording head 6. The recording head 6 is constructed in substantially the same manner as the recording head shown in FIGS. 10 and 11. The same elements or portions are designated by the same reference numerals.

The carriage 1 is connected to a pulse motor (a stepping motor) 3 via a timing belt 2 to be reciprocated along a direction of width of a recording paper 5 and guided by a guide bar 4. The recording head 6 mounted under the carriage 1 is adapted to face down to the recording paper 5. The ink in the chambers of the ink cartridge 7 is supplied to the recording head 6. While the carriage 1 is moved, the recording head 6 jets ink (ink drops or ink particles) on the recording paper 5 to print images or characters as dot matrices.

The capping unit 8 is disposed in a nonprinting region within a movable region of the carriage 1. The capping unit 8 is adapted to prevent the ink in the nozzles 40 from drying as much as possible by sealing the nozzles of the recording head 6 while the ink-jet recording apparatus is not in the printing operation. The capping unit 8 further functions as a container for receiving ink jetted from the recording head 6 in the flushing operation. In addition, the capping unit 8 is connected to the suction pump 9 to generate a negative pressure therein and to absorb ink from the nozzles in the cleaning operation by the negative pressure.

Figure 2:
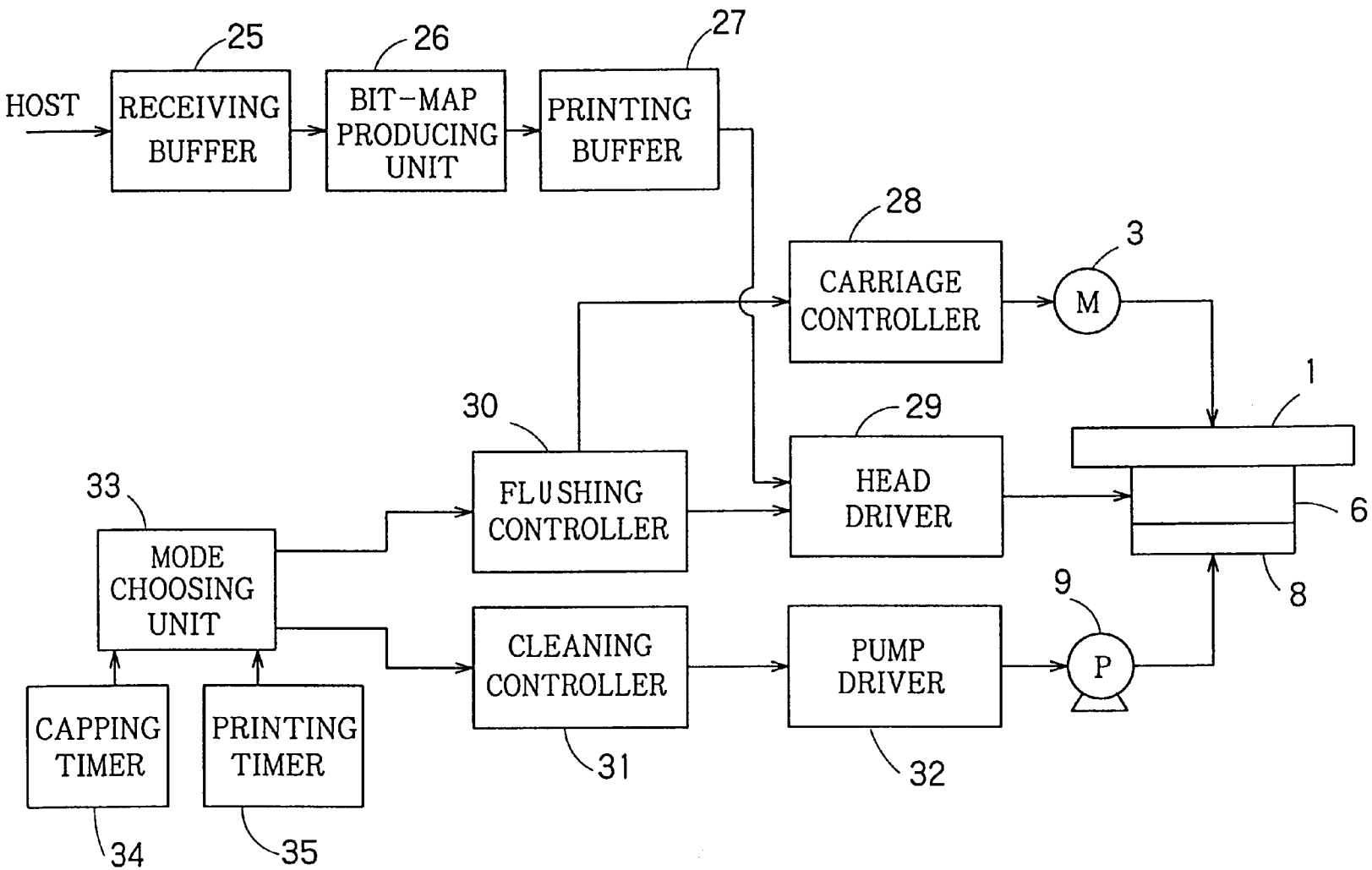
FIG. 2 is a schematic block diagram of the first embodiment of the ink-jet recording apparatus according to the invention.

FIG. 2 is a schematic block diagram of the first embodiment of the ink-jet recording apparatus according to the invention. As shown in FIG. 2, a receiving buffer 25 can receive printing data from a host computer (not shown). A bit-map producing unit 26 can convert the printing data into bit-map data. A printing buffer 27 can temporarily store the bit-map data.

A head driver 29 can supply driving voltages to the piezoelectric vibrating members 42 respectively based on a printing signal from the printing buffer 27 to cause the recording head 6 to jet ink to carry out a printing operation. At a starting time of a flushing operation, the head driver 29 can supply driving voltages in no relation to the printing signal to the piezoelectric vibrating members 42 so as to cause the recording head 6 to jet ink to carry out the flushing operation.

A pump driver 32 can control the suction pump 9 to generate a negative pressure and to forcibly absorb ink from all the nozzles 40 by the negative pressure to carry out a cleaning operation.

A carriage controller 28 can reciprocate the carriage 1 (i.e., the recording head 6) via the pulse motor 3 in the printing operation. The carriage controller 28 can move the carriage 1 to such a position that the recording head 6 faces the capping unit 8 before a flushing operation or at the end of the printing operation.

A capping timer 34 can start to operate by receiving a signal informing that the recording head 6 is sealed by the capping unit 8 from the carriage controller 28. Thus, the capping timer 34 can measure a capping time for which the nozzles of the recording head 6 remains sealed by the capping unit 8. A printing timer 35 can start to operate by receiving signals informing that the printing operation is started from the head driver 29 and the carriage controller 28. Thus, the printing timer 35 can measure a total printing time for which the recording head 6 is away from the capping unit 8 until the recording head 6 is moved back to and sealed by the capping unit 8. The capping timer 34 may be reset when the timer 34 outputs a signal. Similarly, the printing timer 35 may be reset when the timer 35 outputs a signal.

A mode choosing unit 33 can receive the signal of the capping time and the signal of the printing time outputted from the capping timer 34 and the printing timer 3 5, respectively. The mode choosing unit 33 can choose one mode of either a flushing mode to-carry out a flushing operation, or a cleaning mode to carry out a cleaning operation, according to the combination of the capping time and the printing time. Then the mode choosing unit 33 can output a signal of the chosen mode (see FIG. 13).

A flushing controller 30 can receive the signal from the mode choosing unit 33, and cause the head driver 29 to supply driving voltages to the piezoelectric vibrating members 42 respectively based on the signal to control the flushing operation as described below. The piezoelectric vibrating members 42 can repeatedly expand and contract (vibrate) to jet ink from the nozzles 40 communicating with the pressure chambers 41, whichever pressure chambers 41 are arranged close to or far from the ink supplying hole 52.

A cleaning controller 31 can also receive the signal from the mode choosing unit 33, and control the pump driver 32 to control the cleaning operation.

Figure 3:
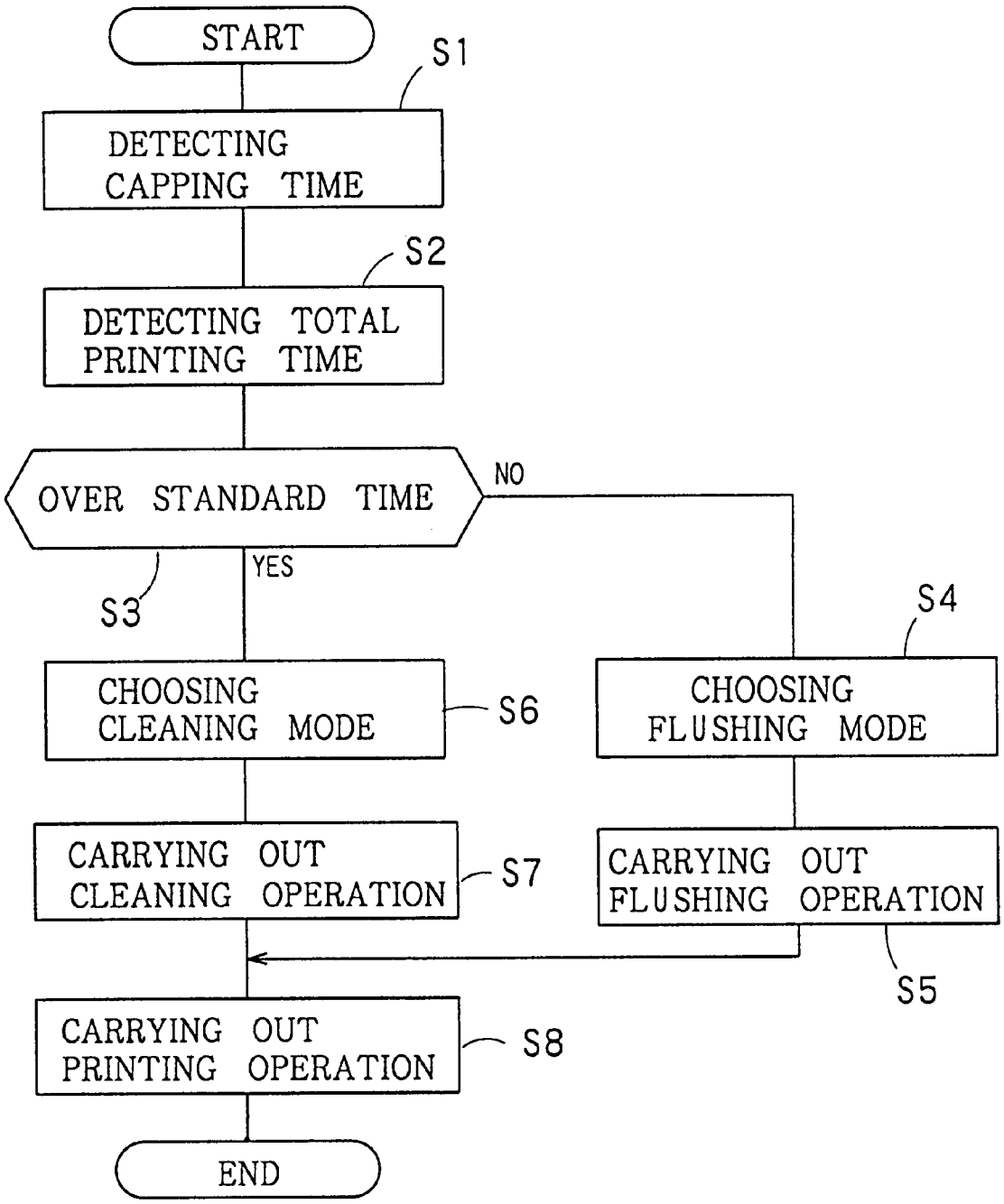
FIG. 3 is a flow chart showing an operation of the ink-jet recording apparatus of the first embodiment.

An operation of the ink-jet recording apparatus is explained with reference to the flow chart shown in FIG. 3. S in FIG. 3 means a step.

The capping timer 34 measures and detects the capping time at a starting time of power supply or at a starting time of the printing operation (S1). At substantially the same time, the printing timer 35 measures and detects the total printing time (S2). The mode choosing unit 33 judges whether the current condition is over a standard line (see FIG. 13) based on the combination of the capping time and the printing time (S3). If the condition is not over the standard line (a flushing area shown in FIG. 13), the choosing unit 33 chooses a flushing mode (S4). If the condition is over the standard line (a cleaning area shown in FIG. 13), the choosing unit 33 chooses a cleaning mode (S6).

Figure 4:
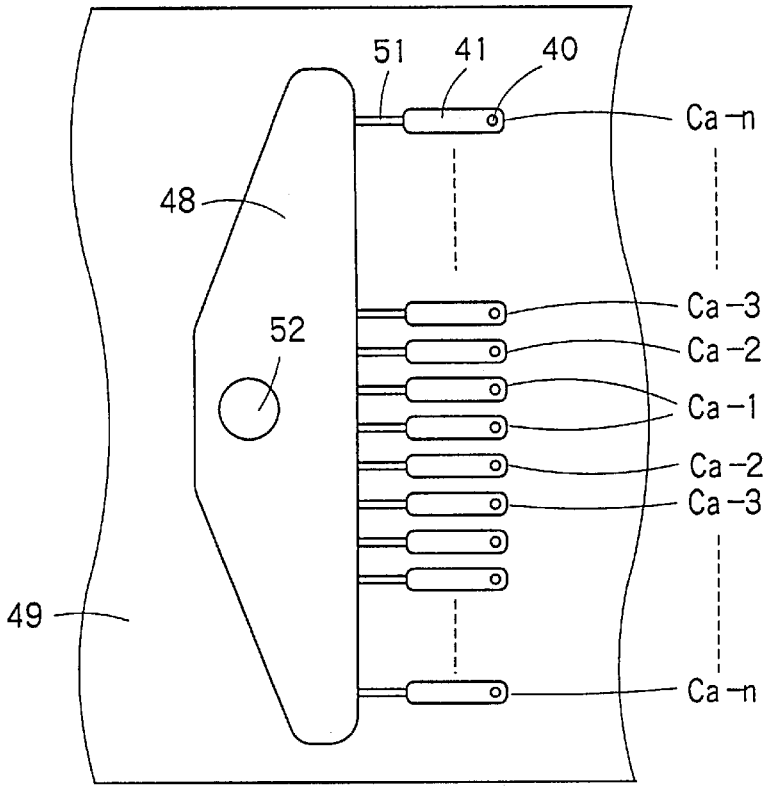
FIG. 4 is a plan view of the passage forming plate and the nozzle plate of the recording head of the first embodiment.
Figure 5:
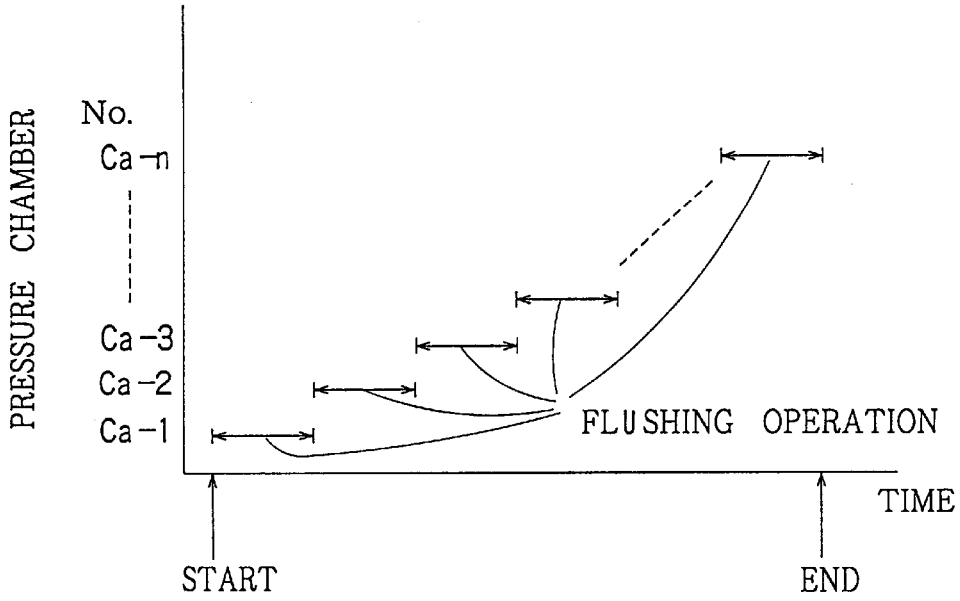
FIG. 5 is an explanatory graph for showing the operation of the ink-jet recording apparatus of the first embodiment.

In the first embodiment, as shown in FIGS. 4 and 5, if the flushing mode is chosen, the first flushing operations are carried out for the pressure chambers Ca-1 arranged closest to the ink supplying hole 52. After the first flushing operations for the pressure chambers Ca-1 are completed, the second flushing operations are carried out for the pressure chambers Ca-2 arranged adjacent to both sides of the pressure chambers Ca-1. Both of the pressure chambers Ca-2 are arranged second closest to the ink supplying hole 52. Similarly, the flushing operations are carried out for the pressure chambers Ca-3 to Ca-n in order of respective distances of the pressure chambers from the ink supplying hole 52 (ink way). Both of the pressure chambers designated by the same reference numeral are arranged at an approximately equal distance from the ink supplying hole 52. After the flushing operations are completed, the printing operation is carried out (S8).

As described above, the flushing operations are carried out by turns from the pressure chambers Ca-1 closest to the ink supplying hole 52 to the pressure chambers Ca-n furthest from the supplying hole 52. Thus, new ink is easily and sufficiently supplied into the pressure chamber arranged relatively further from the ink supplying hole 52 in the flushing operation. This reduces the difference in viscosity of the ink by portions in the ink saving chamber 48.

If the cleaning mode is chosen, the cleaning controller 31, the pump driver 32 and the suction pump 9 carry out the cleaning operation (S7). That is, the ink having a large viscosity in all the nozzles 40 of the recording head 6 is forcibly absorbed and removed by the negative pressure applied by the suction pump 9. After the cleaning operation, the printing operation is carried out (S8).

According to the first embodiment, the difference in viscosity of the ink in different portions of the ink saving chamber 48 may be curbed. Thus, in the flushing operations, sufficient volumes of ink may be respectively jetted from the nozzles 40 communicating with the pressure chambers 41, even if the pressure chambers 41 are arranged far from the ink supplying hole 52. That is, the ability of the nozzles 40 to jet ink can be recovered sufficiently to prevent the quality of printing from deteriorating. In addition, a meniscus of the ink may remain stable to prevent an air bubble from being formed in the nozzles 40 since the new ink is always supplied by the flushing operations. Furthermore, the flushing area may be enlarged, and the volume of ink necessary to recover the ability of the nozzles to jet ink may be reduced.

Second Embodiment

Figure 6:
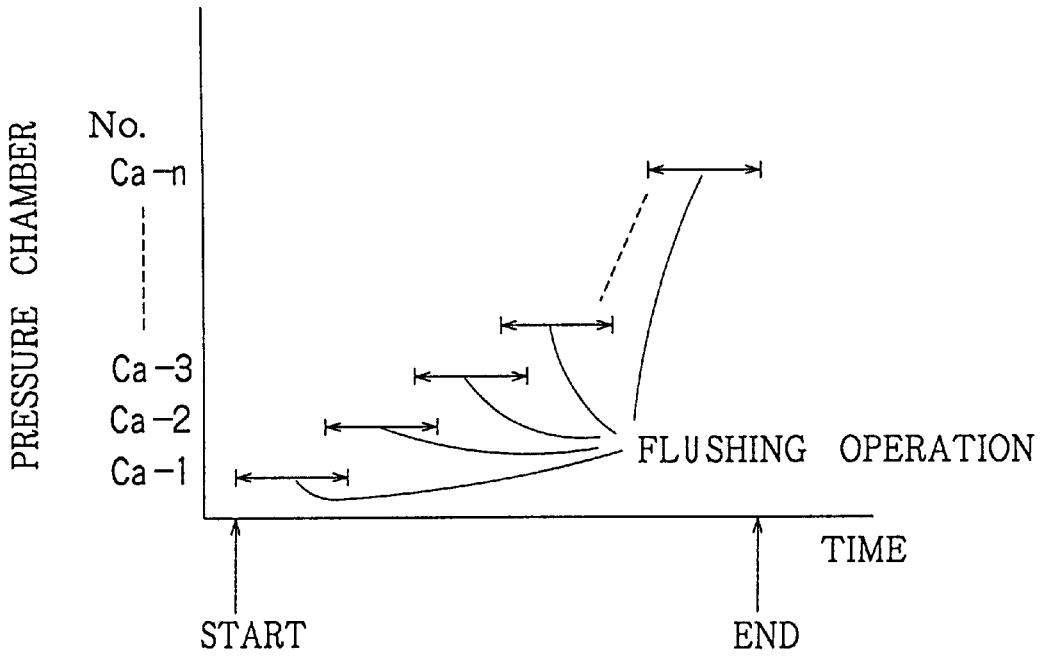
FIG. 6 is an explanatory graph for showing the operation of the ink-jet recording apparatus of a second embodiment.

FIG. 6 is an explanatory graph for showing the operation of the ink-jet recording apparatus of a second embodiment. In the second embodiment, the first flushing operations are carried out for the pressure chambers Ca-1 arranged closest to the ink supplying hole 52 in the same manner as the first embodiment. In addition, the second flushing operations for the pressure chambers Ca-2 are delayed in starting for a predetermined time with respect to the first flushing operations in substantially the same manner as the first embodiment. However, before the first flushing operations for the pressure chambers Ca-1 are completed, the second flushing operations start. Similarly, the flushing operations are carried out for the pressure chambers Ca-3 to Ca-n in order of the reference numerals, while partly overlapping.

According to the second embodiment, since the flushing operations for each two of the adjacent pressure chambers are carried out partly simultaneously, all the flushing operations are completed by a shorter period. Of course, the second embodiment has substantially the same advantages as the first embodiment.

Third Embodiment

Figure 7:
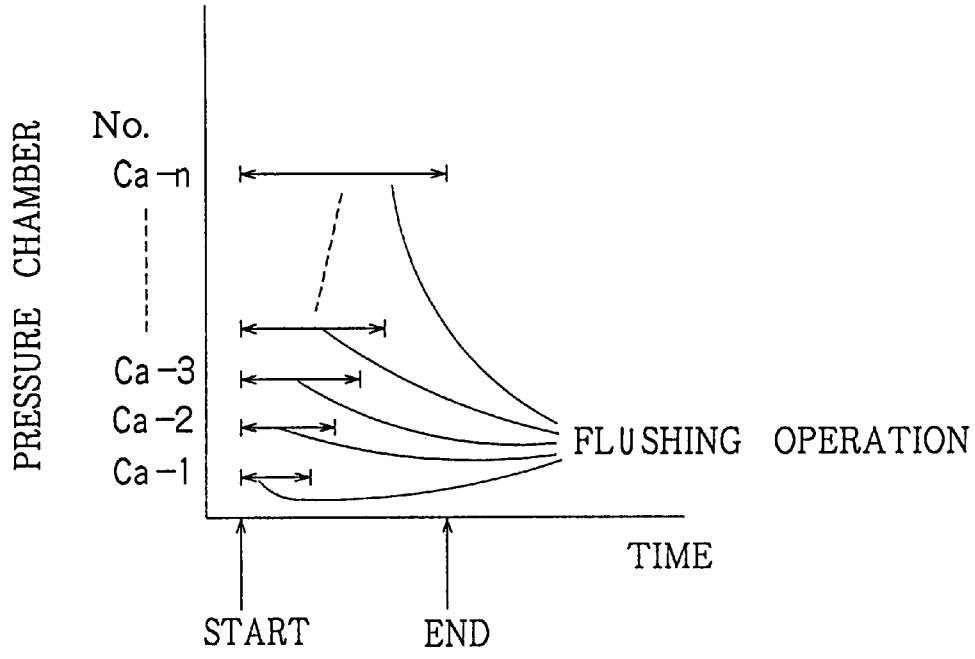
FIG. 7 is an explanatory graph for showing the operation of the ink-jet recording apparatus of a third embodiment.

FIG. 7 is an explanatory graph for showing the operation of the ink-jet recording apparatus of a third embodiment.

In the third embodiment, if the flushing mode is chosen, the flushing operations for all the pressure chambers start simultaneously. Then, the flushing operations for the pressure chambers Ca-1 arranged closest to the ink supplying hole 52 end after a predetermined time. Next, the flushing operations for the pressure chambers Ca-2 arranged adjacent to both sides of the pressure chambers Ca-1 end after a predetermined time. Similarly, the flushing operations for the pressure chambers Ca-3 to Ca-n end in order of their respective distances from the ink supplying hole 52.

According to the third embodiment, the further the pressure chambers are arranged from the ink supplying hole 52, the greater the volume of the ink that is jetted in the flushing operations for the pressure chambers. Thus, new ink is easily (smoothly) and sufficiently supplied into the pressure chamber arranged relatively further from the ink supplying hole 52 in the flushing operation. In this case, the new ink may also be easily supplied into the whole ink saving chamber 48. Furthermore, since the flushing operations for all the pressure chambers start simultaneously, the flushing operations may be completed in a shorter period. Otherwise, the third embodiment has substantially the same advantage as the first embodiment.

Fourth Embodiment

Figure 8:
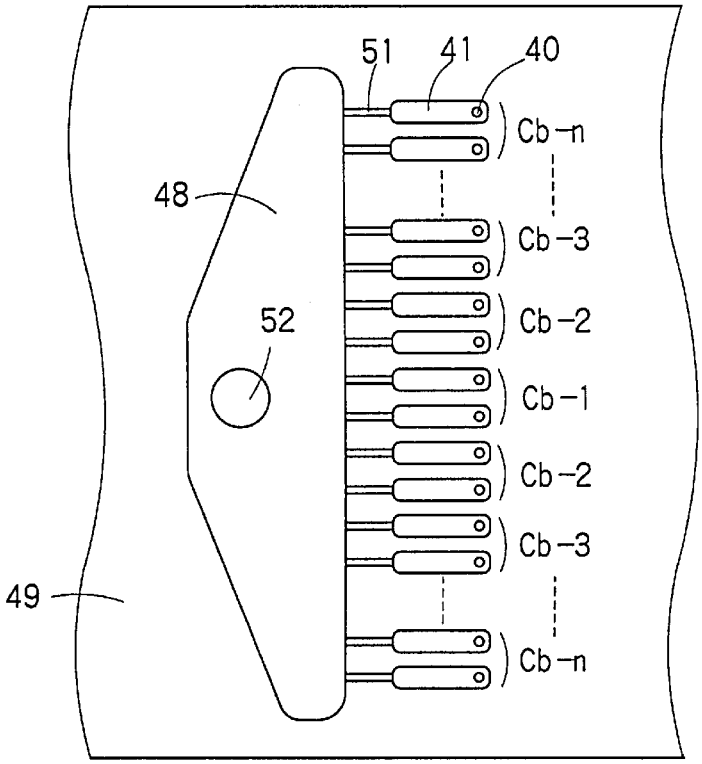
FIG. 8 is a plan view of the passage forming plate and the nozzle plate of the recording head of a fourth embodiment.

FIG. 8 is a plan view of the passage forming plate and the nozzle plate of the recording head of a fourth embodiment.

In the fourth embodiment, the pressure chambers 41, are classified into n classes (groups) according to respective distances of the pressure chambers 41 from the ink supplying hole 52. In this case, if a distance between the ink hole and a pressure chamber of a first class is less than a distance between the ink hole and a pressure chamber of a second class, a distance of any pressure chamber of the first class from the ink hole is less than a distance of any pressure chamber of the second class from the ink hole. In addition, in this case, each class consists of two adjacent pressure chambers as shown in FIG. 8.

In the fourth embodiment, if the flushing mode is chosen, the first flushing operations are carried out for the pressure chambers belonging to the class Cb-1, which is closest to the ink supplying hole 52. After the first flushing operations for the pressure chambers of the class Cb-1 are completed, second flushing operations are carried out for the pressure chambers belonging to the class Cb-2, which is second closest to the ink supplying hole 52. Similarly, the flushing operations are carried out for the pressure chambers belonging to the class Cb-3 to the pressure chambers belonging to the class Cb-n in order of respective distances of the classes from the ink supplying hole 52.

According to the fourth embodiment, since the flushing operations for all pressure chambers of each class are delayed starting for the same predetermined time, the flushing operations may be easily controlled and completed by a shorter period. Otherwise, the fourth embodiment has substantially the same advantage as the first embodiment.

In the fourth embodiment, the flushing operations may be carried out for the pressure chambers of the respective classes Cb-1 to Cb-n in order of the reference numerals while being partly overlapped, similarly to the second embodiment. Such flushing operations may be completed by a much shorter period.

In the fourth embodiment, the flushing operations may start simultaneously for all the pressure chambers, and then may be delayed ending in order of the respective classes Cb-1 to Cb-n, similarly to the third embodiment. Such flushing operations may be completed by a much shorter period.

Fifth Embodiment

Figure 9:
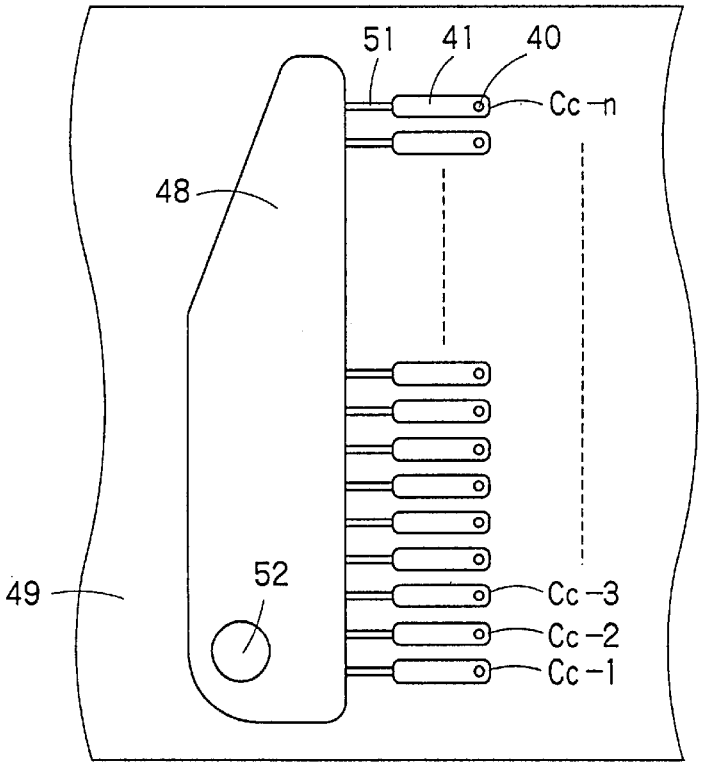
FIG. 9 is a plan view of the passage forming plate and the nozzle plate of the recording head of a fifth embodiment.

FIG. 9 is a plan view of the passage forming plate and the nozzle plate of the recording head of the fifth embodiment.

In the fifth embodiment, the ink supplying hole 52 is not connected to a substantially middle portion of the ink saving chamber 48, but to one end portion of the ink saving chamber 48. The flushing operations are carried out for the pressure chambers Cc-1 to Cc-n in order of respective distances of the pressure chambers from the ink supplying hole 52, that is, in order of the reference numerals. The fifth embodiment also has substantially the same advantage as the first embodiment.

The flushing controller may control a driving frequency of the driver for causing respective pressures in the pressure chambers to change, in order to adjust the volume of ink jetted from the nozzles in the flushing operations.

For example, the driving frequency may be controlled high when the volume of the ink jetted in the flushing operation is large, that is, when the ink is jetted from the nozzle far from the ink supplying hole 52. On the contrary, the driving frequency may be controlled low when the volume of the ink jetted in the flushing operation is small, that is, when the ink is jetted from the nozzle close to the ink supplying hole 52. In that case, the volume of the waste ink due to the flushing operations may be reduced.

Alternatively, the flushing controller may control respective changing ranges of the pressures in the respective pressure chambers via the driver, in order to adjust the volumes of ink jetted from the nozzles in the flushing operations.

The flushing operations are carried out at a starting time of the printing operation in the above embodiments. However, the flushing operations may be carried out during the printing operation in what is called periodic flushing operations. Furthermore, the flushing operations may be carried out after a continuous printing operation of a predetermined time in what is called periodic forcible flushing operations.

In the above embodiments, the recording head includes the piezoelectric vibrating members 42 which expand and contract in a longitudinal direction. However, the recording head may include another type of vibrating member which causes pressure chambers to expand or contract by distortion thereof. In addition, a bubble-jet recording head includes a plurality of heating members 42' mounted on the respective pressure chambers (for example, as shown in FIG. 15) to change the pressure in the respective pressure chambers.

In the above embodiments, the flushing controller 30 may control the driving frequency of the head driver 29 in such a manner that the driving frequency is high at a beginning time of the flushing operation, and that the driving frequency is low at a later time. According to the feature, the ink in the nozzle may be loosened by the flushing operation of the high frequency. Thus, the flushing operation may be carried out more effectively.

According to this invention, the flushing operation for the pressure chamber arranged relatively further from the ink way (ink supplying hole) is delayed in starting for a predetermined time as indicated in FIG. 16. Thus, new ink is easily and sufficiently supplied into the pressure chamber arranged relatively further from the ink way in the flushing operations. This reduces the difference in viscosity of the ink in different portions in the ink saving chamber. Therefore, in the flushing operations, a sufficient volume of ink may be respectively jetted from the nozzles communicating with the pressure chambers, even if far from the ink way. That is, the ability of the nozzles to jet ink can be recovered sufficiently to prevent the quality of printing from deteriorating.

In addition, a meniscus of the ink may remain stable to prevent an air bubble from being taken in the nozzles since the new ink is always supplied by the flushing operations. Furthermore, the flushing area wherein the ability of the nozzles to jet ink can be recovered by only the flushing operations may be enlarged. In addition, the volume of ink necessary to recover the ability of the nozzles to jet ink may be reduced, the volume of ink capable of being used for the printing operation may be increased, and the total volume of the waste ink may be reduced.

In addition, according to this invention, the volume of the ink jetted in the flushing operation for the pressure chamber arranged relatively further from the ink way (ink supplying hole) is greater as indicated in FIG. 17. Thus, new ink is easily (smoothly) and sufficiently supplied into the pressure chamber arranged relatively further from the ink way during the flushing operation. This also reduces the difference in viscosity of the ink in different portions of the ink saving chamber. Therefore, in the flushing operations, sufficient volumes of ink may be respectively jetted from the nozzles communicating with the pressure chambers, even if far from the ink way. That is, the ability of the nozzles to jet ink can be recovered sufficiently to prevent the quality of printing from deteriorating. In addition, the flushing area may be enlarged, the volume of ink necessary to recover the ability of the nozzles to jet ink may be reduced, the volume of ink capable of being used for the printing operation may be increased, and the total volume of the waste ink may be reduced.

When the respective volumes of ink jetted in flushing operations for all pressure chambers are great in order of respective distances of the pressure chambers from the ink way, the new ink may be easily supplied into the whole ink saving chamber.

When the flushing operations for all the pressure chambers start simultaneously, the flushing operations may be completed by a shorter period.

When the flushing operations for all pressure chambers of each class are delayed in starting for the same predetermined time, the flushing operations may be easily controlled and completed in a shorter period.

When the volumes of ink jetted in the flushing operations for all the pressure chambers of each class are the same levels, the flushing operations may be easily controlled and completed in a shorter period.

What is claimed is:

1. An ink-jet recording apparatus comprising:

a recording head including a plurality of nozzles, a plurality of pressure chambers communicating with said plurality of nozzles, a plurality of pressure generating elements each communicating with one of said plurality of pressure chambers, an ink saving chamber communicating with said plurality of pressure chambers for supplying ink into said plurality of pressure chambers and for temporarily storing the ink, and an ink way communicating with said ink saving chamber for supplying the ink into said ink saving chamber;

a driver connected to said plurality of pressure generating elements for driving said pressure generating elements to change a pressure in each of said pressure chambers such that the ink in said pressure chambers is jetted from said nozzles during a flushing operation; and a flushing controller connected to said driver and operable to:

control said driver during the flushing operation such that a flushing operation of a first pressure chamber located a first distance from said ink way has a start delayed for a predetermined time with respect to a flushing operation of a second pressure chamber located a second distance from said ink way, wherein said first distance is greater than said second distance; and control said driver during the flushing operation such that a volume of ink jetted from said first pressure chamber during the flushing operation is greater than a volume of ink jetted from said second pressure chamber during the flushing operation.

2. The apparatus of claim 1, wherein said flushing controller is operable to control said driver such that a volume of ink jetted from each of at least three pressure chambers increases as a distance between each of said at least three pressure chambers and said ink way increases.

3. The apparatus of claim 1, wherein said flushing controller is operable to control said driver such that a volume of ink jetted from each of said plurality of pressure chambers increases as a distance between each of said plurality of pressure chambers and said ink way increases.

4. The apparatus of claim 1, wherein said plurality of pressure chambers includes a first group of pressure chambers and a second group of pressure chambers, wherein a distance between each of said pressure chambers in said first group and said ink way is less than a distance between each of said pressure chambers in said second group and said ink way; and wherein said flushing controller is operable to control said driver such that a volume of ink jetted from each pressure chamber in said first group is substantially identical, and such that a volume of ink jetted from each pressure chamber in said second group is substantially identical, wherein the volume of ink jetted from each pressure chamber in each group is based on a distance between said pressure chambers and said ink way.

5. The apparatus of claim 1, wherein said flushing controller is operable to control a driving frequency of said driver.

6. The apparatus of claim 5, wherein said flushing controller is operable to control the driving frequency of said driver such that the driving frequency at a start of the flushing operation is higher than a driving frequency at an end of the flushing operation.

7. The apparatus of claim 5, wherein said flushing controller is operable to control the driving frequency of said driver such that the driving frequency is directly proportional to the volume of ink jetted from each of said pressure chambers during the flushing operation.

8. The apparatus of claim 1, wherein said flushing controller is operable to control changes in the pressure in each of said pressure chambers by controlling said driver.

9. The apparatus of claim 1, wherein said plurality of pressure generating elements comprise a plurality of piezoelectric members mounted on respective pressure chambers so as to change a pressure in said respective pressure chambers.

10. The apparatus of claim 1, wherein said plurality of pressure generating elements comprise a plurality of heating members mounted on respective pressure chambers so as to change a pressure in said respective pressure chambers.

* * * * *